US005418514A

United States Patent [19]

Smith et al.

[11] Patent Number: 5,418,514

[45] Date of Patent: May 23, 1995

[54] AC CURRENT SENSOR AND METHOD OF MAKING SAME

[76] Inventors: Dayle R. Smith, 1596 Turner Rd., Colorado Springs, Colo. 80918; Bayard W. Hart, 429 Yucca Dr., Colorado Springs, Colo. 80906

[21] Appl. No.: 55,910

[22] Filed: May 3, 1993

Related U.S. Application Data

[63] Continuation of Ser. No. 336,569, Apr. 10, 1989, abandoned, which is a continuation-in-part of Ser. No. 925,540, Oct. 28, 1986, abandoned, which is a continuation of Ser. No. 660,459, Oct. 12, 1984, abandoned.

[51] Int. Cl.[6] ..... H01F 27/26; H01F 17/04

[52] U.S. Cl. ..... 336/210; 336/221; 336/233

[58] Field of Search ..... 336/221, 213, 176, 229, 336/174, 198, 233, 234, 210

[56] References Cited

U.S. PATENT DOCUMENTS

| | | | |
|---|---|---|---|
| 708,220 | 9/1902 | Gill | 336/213 X |
| 714,891 | 12/1902 | Gill | 336/213 X |
| 1,735,092 | 11/1929 | Roller | 336/174 |
| 1,862,613 | 6/1932 | Tomoda | 336/175 |
| 2,327,774 | 8/1943 | Dickinson | 336/174 |
| 2,478,029 | 8/1949 | Vienneau | 336/176 X |
| 2,686,898 | 8/1954 | Schweitzer, Jr. | 336/175 |
| 2,729,788 | 1/1956 | Schweitzer, Jr. | 336/174 |
| 2,865,086 | 12/1958 | Whipple | 336/229 X |
| 2,885,646 | 5/1959 | Bugg | 336/221 |
| 2,888,654 | 5/1959 | Bugg | 336/221 |
| 3,340,472 | 9/1967 | Schweitzer, Jr. | 336/175 |
| 3,659,336 | 5/1972 | Horne | 336/198 X |
| 3,678,341 | 7/1972 | Constable | 336/175 |
| 3,683,237 | 8/1972 | Walstad et al. | 336/175 |
| 3,683,302 | 8/1972 | Butler et al. | 336/175 |
| 3,725,832 | 4/1973 | Schweitzer, Jr. | 336/176 X |
| 4,262,209 | 4/1981 | Berner | 307/44 X |
| 4,295,112 | 10/1981 | Yamada et al. | 336/178 |
| 4,456,873 | 6/1984 | Schweitzer, Jr. | 336/176 X |

FOREIGN PATENT DOCUMENTS

| | | | |
|---|---|---|---|
| 1219819 | 5/1960 | France | 336/221 |
| 1548528 | 12/1968 | France | 336/174 |
| 2278141 | 2/1976 | France | 336/119 |
| 727240 | 5/1943 | Germany | 336/213 |
| 264993 | 5/1929 | Italy | 336/213 |
| 45-12686 | 9/1966 | Japan | 336/221 |
| 51-167157 | 7/1978 | Japan . | |
| 29566 | 2/1980 | Japan | 336/221 |
| 55-47573 | 11/1981 | Japan . | |
| 106011 | 7/1982 | Japan | 336/221 |
| 8047 | 6/1896 | Sweden | 336/176 |
| 644355 | 10/1950 | United Kingdom . | |
| 834165 | 5/1960 | United Kingdom | 336/221 |
| 2000873 | 1/1979 | United Kingdom . | |
| 2026175 | 1/1980 | United Kingdom . | |

*Primary Examiner*—Thomas J. Kozma

*Attorney, Agent, or Firm*—Oblon, Spivak, McClelland, Maier & Neustadt

[57] ABSTRACT

A current sensor having a single-turn primary coil where the secondary coil is wound on a straight core that is bent so that diametrically opposed ends are electrically, mechanically and magnetically connected to form the primary coil.

19 Claims, 15 Drawing Sheets

5A. WAVEFORM COMPARISON

1. VOLTAGE DRIVING CURRENT
2. TOROID OUTPUT VOLTAGE
3. SRT CURRENT SENSOR OUTPUT

150MA WAVEFORM COMPARISON

1. VOLTAGE DRIVING CURRENT
2. TOROID OUTPUT
3. SRT CURRENT SENSOR OUTPUT

WAVEFORM COMPARISON AT 100 AMPS

1. VOLTAGE DRIVING CURRENT LOOP
2. TOROID OUTPUT VOLTAGE
3. SRT CM12 OUTPUT VOLTAGE

WAVEFORM COMPARISON AT 30 AMPS

1. VOLTAGE DRIVING CURRENT LOOP
2. TOROID OUTPUT VOLTAGE
3. SRT CQ12 OUTPUT VOLTAGE

AC CURRENT SENSOR AND METHOD OF MAKING SAME

This application is a continuation of application Ser. No. 07/336,569, filed on Apr. 10, 1989, now abandoned, which is a continuation-in-part of Ser. No. 06/925,540, filed Oct. 28, 1986, now abandoned, which is a continuation of Ser. No. 06/660,459, filed Oct. 12, 1984, now abandoned.

BACKGROUND OF THE INVENTION

1. Field of the Invention

This invention relates to current sensors.

2. Discussion of the Background

Due to the need for miniature inductor structures for use in micro-modules, such as those used in the hearing aid industry, there have been developed not only more sensitive and efficient devices but those that are more economical. This need has resulted in more precise and concentrated material refinement with the associated development technology. In the search for a tiny, reliable, sensitive telephone coil, the current sensor of the present invention was produced.

It is well known that a wound toroid coil provides a good current transformer. If a wire carrying a current to be measured is passed through the hole in the toroid a one-turn primary winding is formed and the turns ratio from the primary to the secondary is determined by the number of turns on the toroid core. Based on electrical characteristics, the theoretical ideal form for inductance devices is a toroid. However, toroid coils and transformers are difficult and expensive to construct, particularly because of the difficulty in applying multiple windings to completely closed toroid cores in mass production.

In an attempt to solve this problem U.S. Pat. No. 3,238,484 provides a method of making an inductance device by applying a coil structure to an arched magnetic core member of substantially uniform cross sectional area and having two ends, by applying a magnetic bridge member directly across the ends of the arched member, by then adjusting the spacing between the bridge member and the arched member until the winding exhibits a predetermined value of inductance, and by finally fixing the relative position of arched and bridge members, thus making the adjusted D-shaped core juncture permanent.

In contrast, the present invention provides a straight magnetic core which allows for ease in winding a multi-turn coil with a large number of turns in a simple winding chuck while protecting the coil against stress and strain in retaining the core straight under the coil by bending the ends of the straight core beyond the coil into a curved portion until the ends make magnetic contact and are permanently connected as by welding, crimped or wire wrapped to provide a single connection. Dacy on the other hand provides multiple connection between multiple sections of curved core portions.

Another pertinent patent is U.S. Pat. No. 1,735,092 which is directed to a transformer having effectively a single-turn core that is provided with a plurality of loops therein for the purpose of increasing the sensitivity, which teaches away from the use of a single-turn device. Other patents of interest are: U.S. Pat. No. 2,137,878; U.S. Pat. No. 2,659,845, U.S. Pat. No. 2,958,835; and U.S. Pat. No. 1,808,670.

Toroid core transformers are used extensively in electronics for power conversion and for signal transfer even at high frequencies. They serve a purpose which other devices cannot fill. However, the toroid transformer suffers from being expensive to produce particularly where a large number of turns are required.

SUMMARY OF THE INVENTION

According to the present invention, there is provided a method of producing a coil that simulates a toroid wound coil, is small in size, and is economical. The coil of the present invention is produced by winding a coil on a straight core which is then bent into a D-shaped core and the ends magnetically connected to provide a D-core coil with the secondary winding residing on the straight portion. Transfer functions of thousands of micro-volts per milliampere have been obtained and operated over a frequency range of 50 Hz to 20 MHz. The transfer function is defined as the voltage at the current sensor output, which is taken across the multi-turn coil as a function of the current flowing in a conductor passing through the center hole of the single turn or D-shaped core. Hysteresis and skin depth effects are evident at certain frequencies, but most important is the capability of transmitting the signal of the conducting wire under very light loading as an inductor rather than as an efficient power converter.

A principal object of the present invention is to provide current sensors which compare favorably with strictly toroidal inductors as to electrical characteristics, but which can be produced at lower costs and with less difficulty.

It is a further object of the invention to provide current sensors which permit high sensitivity for an element of a given volume.

A still further object of the invention is to provide a method of high volume, quality consistent production of current sensors.

The basic object of the invention is based on the use of a straight and easily wound monolithic or single-piece construction core member which is straight and maintained straight beneath the coil winding and the bending of each end beyond the coil into what can be considered a D-core. The ends of the core member are then magnetically connected to provide an effectively continuous core having a straight coil experiencing a minimum amount of stress or strain providing a near error free current sensor. The single piece or monolithic core construction is at the exact point of novelty.

The invention contemplates a current sensor having a single-turn primary winding through which a conductor passes having current flow therein which it is desired to measure or sample. The sensor core on which the sensing coil or secondary winding is wound is a straight core of monolithic or single-piece construction magnetic material and after the coil is wound thereon, the ends of the core are bent into magnetic contact with each other and secured to provide a D-shaped core with the sensing coil being positioned on the remaining straight portion of the core. The curved portions of the D-core are secured in magnetic contact by suitable means.

BRIEF DESCRIPTION OF THE DRAWINGS

For a better understanding of present invention, together with other and further objects thereof, reference is had to the following description taken with the drawings, and its scope will be pointed out in the appended claims.

DETAILED DESCRIPTION OF THE INVENTION

The technology of inductive current sensing today is the electromagnetic toroid; therefore, the toroid, in its most common sizes, is used as a comparison base. The current sensors discussed here come packaged in three sizes: Series A, B, and C. The variation in size is needed to accommodate the flux level needed to measure the current in question. In the numbering code, for example, use the A3G-20; the "A3" means the A case, third size; the G defines the manufacturers code for the core; the "20" defines the number in thousands (i.e., 20 thousands) of turns on the core.

DESIRABLE CHARACTERISTICS for a CURRENT SENSOR:

The following is a list of the desirable characteristics of a current sensor from an instrumentation perspective:

1. High gain at low currents.
2. An air-gap effect to transcend from the high gain to an air-gap controlled output as gently as possible to maintain maximum linearity.
3. Mitigation of the drastic knee, or saturation, that causes flux reversal spikes in a toroid (at light loading).
4. Ability to operate to several times the rated current without damage to the sensor.
5. A floating and isolated output that is similar to a toroid output, in order to avoid signal mixing.
6. High linearity at unloaded or open circuit operation, to keep power dissipation low.
7. Ability to measure the current or flux that surrounds the wire, as with a toroid, which eliminates the need for an auxiliary power source just to measure current.
8. Ability to cover a wide range of frequencies.
9. Ability to cover a wide temperature range.
10. A convenient and easy to use package that will allow operation up to several thousand volts on the line or wire being monitored.
11. A manufacturing process that is adaptable to automatic machines for quantity production at the lowest cost per unit.
12. Voltage output repeatability at identical currents.

Figure 12:
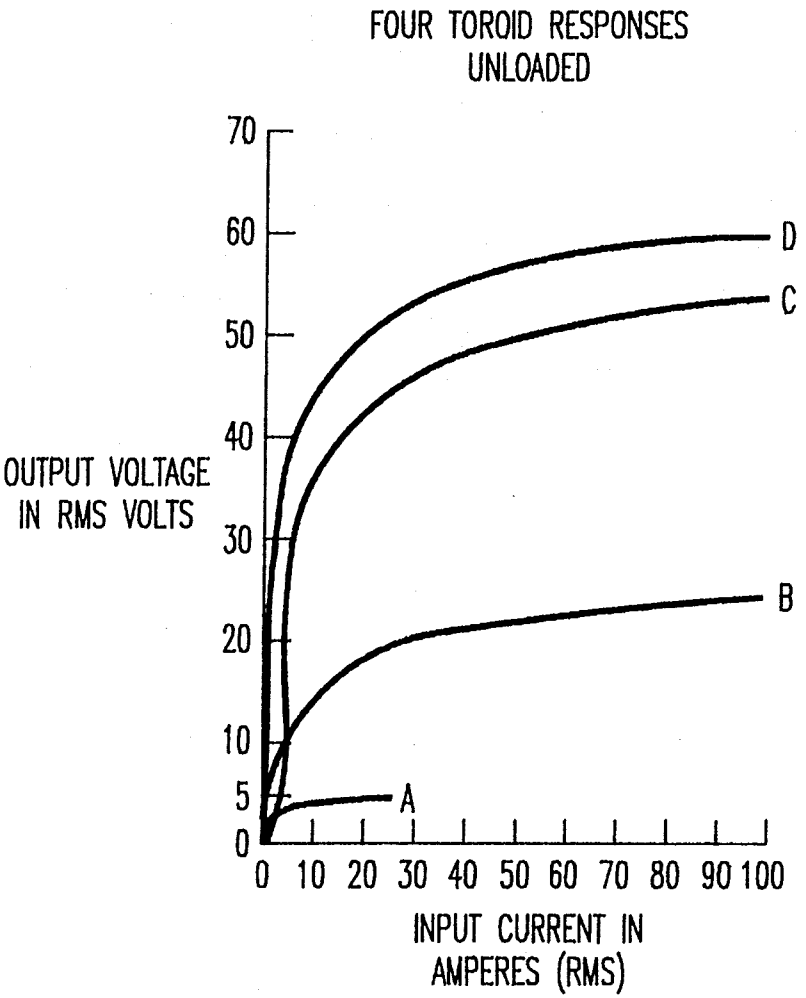
FIG. 12 is a graphical representation of the input amperes versus output voltage.
Figure 12B:
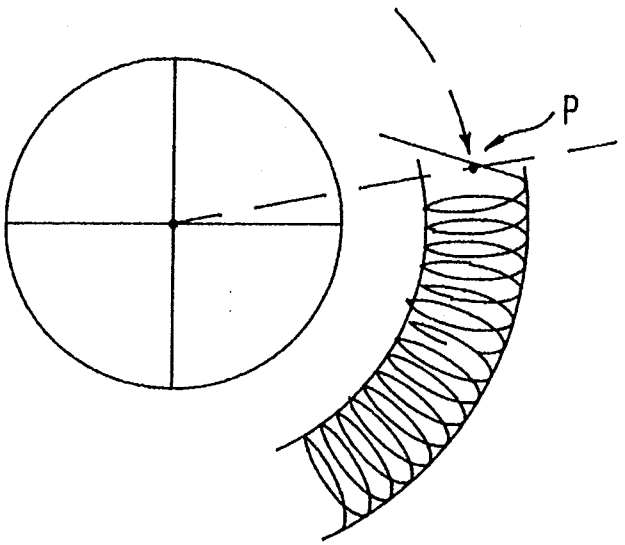
Figure 12A:
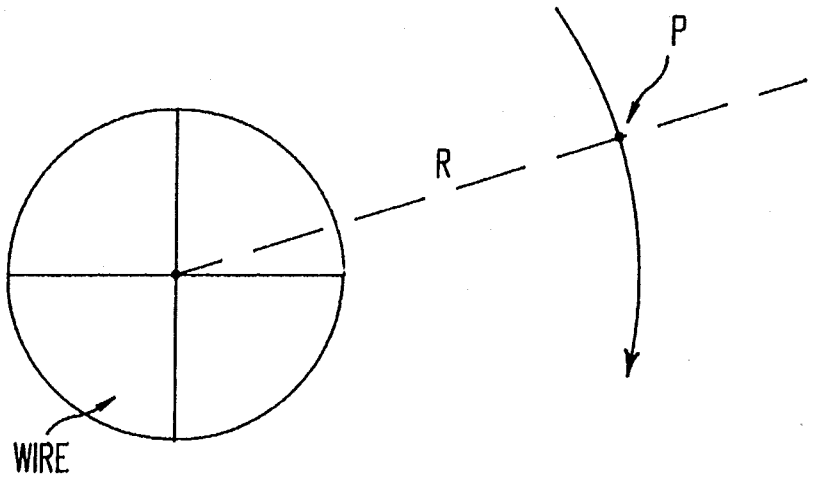

FIG. 12 shows the output voltage versus input current for four popular toroids with 1 Megohm, 20 pf load. These toroids are capable of measuring currents from milliamperes to 100 amperes, when properly loaded.

Figure 13:
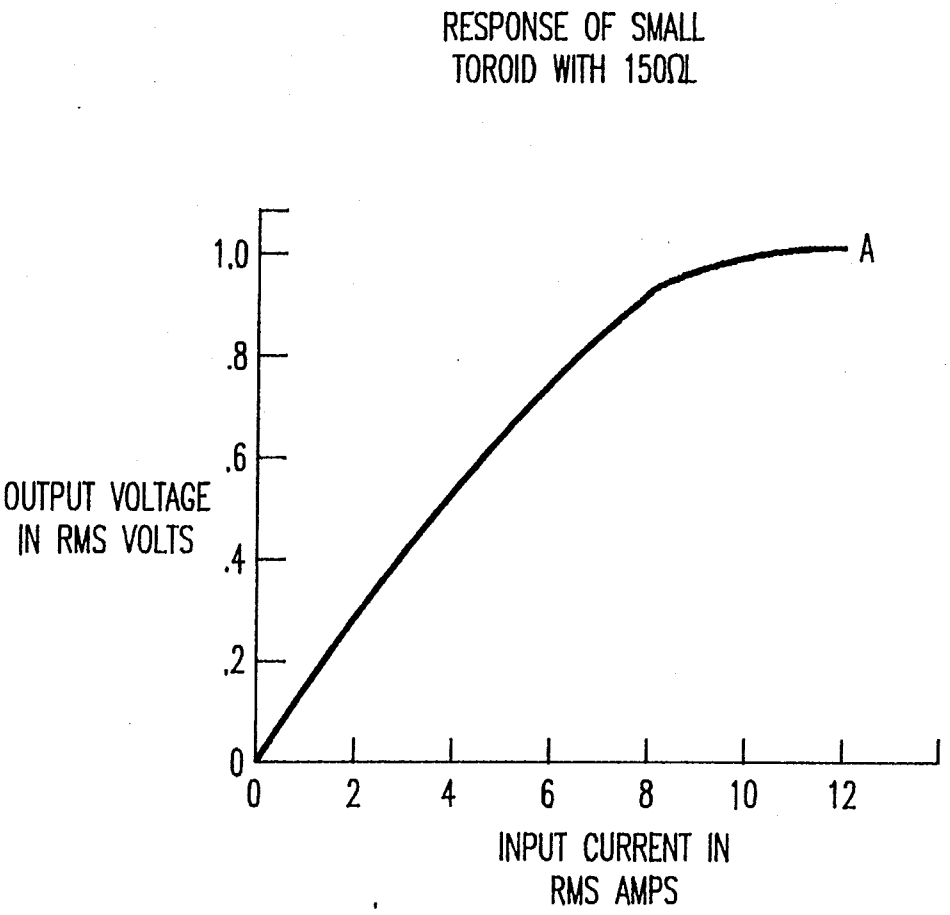
FIG. 13 is a graphical representation of the input current versus voltage.

FIG. 13 shows the little A toroid with 1000 secondary turns with linearity to about 6 amperes when loaded with 150 ohms. Other toroids under load would decrease output but extend the linear range of current as the A core toroid shows with unloaded to loaded operation.

Figure 14:
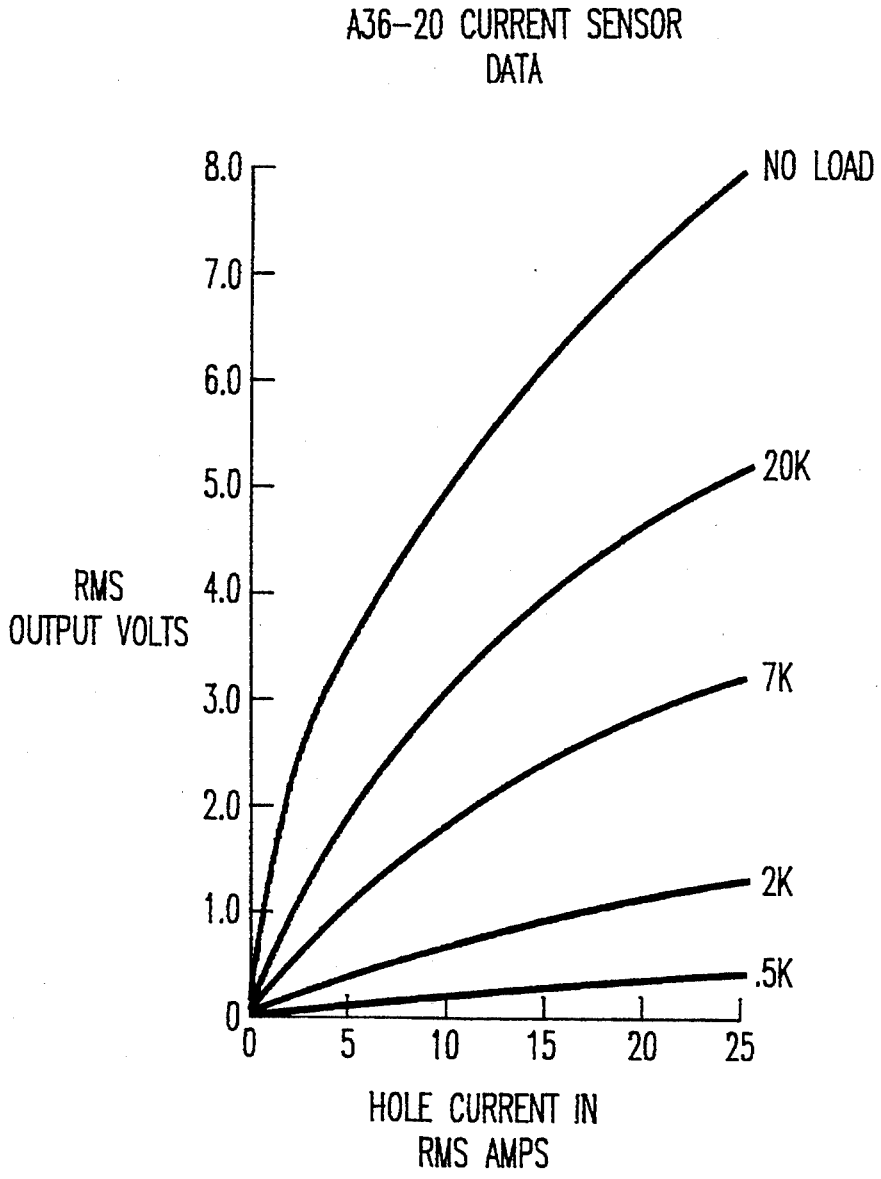
FIG. 14 is a graphical representation of hole current versus output voltage.

FIG. 14 shows, with successively more loading added, the A3G-20 current sensor. Increased gain causes the output voltage to decrease and the linearity to increase. An A core toroid is somewhat similar to this sensor. Note that because of the built-in air-gap in the manufacturing process of the invention, there is no saturation such as shown in FIG. 12 on the equivalently rated A toroid, even though the input current is about five times the rated current for this unit. Also, very good linearity may be obtained with loading. This test shows that current sensing of a particular circuit may be accomplished with very light current draw and then only enough loading is used to obtain the desired linearity.

Figure 15:
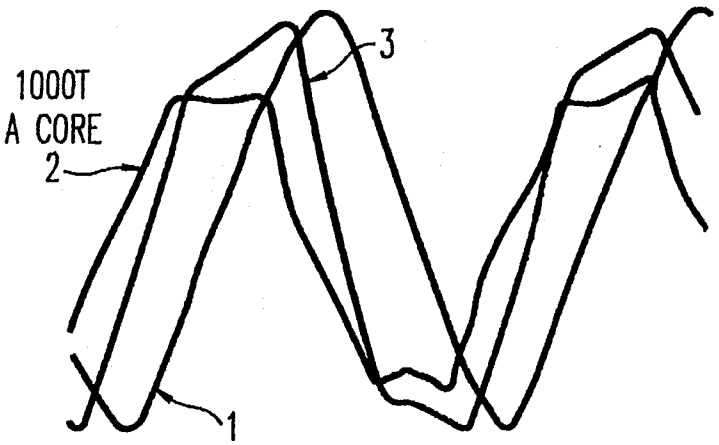
FIG. 15 is a graphical representation of current wave form comparison re driving current, toroid output and sensor output.

FIG. 15 shows operation of an A toroid versus a CQ-12 sensor at 150 ma of input current. The waveforms are quite similar although neither sensor is loaded. Both are plotted against the current loop driving voltage for reference with 1 Megohm plus 20 pf load. In this case, with almost open circuit operation, the toroid is beginning to saturate.

Figure 16:
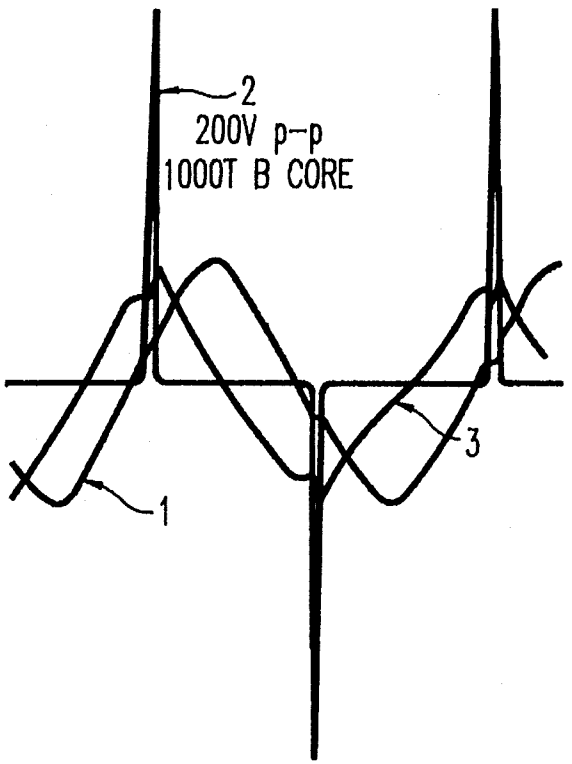
FIG. 16 is a graphical representation of current wave form comparison re driving current, toroid output and sensor output.

FIG. 16 shows the B toroid in the lightly loaded condition at 5 amperes input, plotted against the current loop driving voltage, and compared to the output from the CQ-12 current sensor. Here the toroid is saturating at light loading and developing a voltage spike. The CQ-12 current sensor output show the hysteresis characteristic at this light loading but is perturbed only at the saturation spike of the toroid. This property continues at light loading over the total range of the toroids shown.

Figure 5:
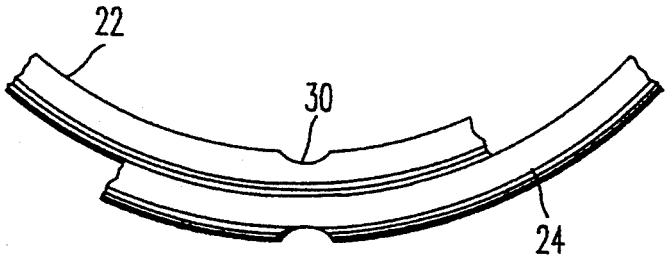
FIG. 5 is a plan view of still another method of connecting the ends of the D-shaped core with portions broken away to conserve space.
Figure 17:
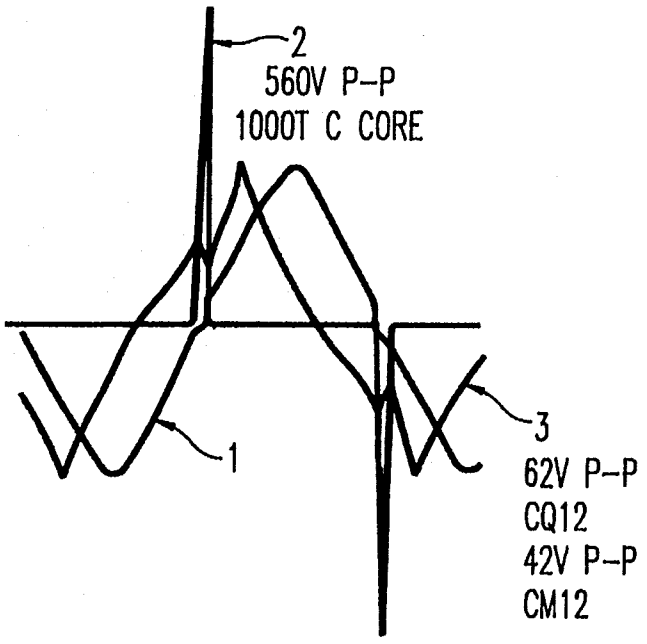
FIG. 17 is a graphical representation of a current wave form comparison re driving current, toroid output and sensor output.
Figure 20:
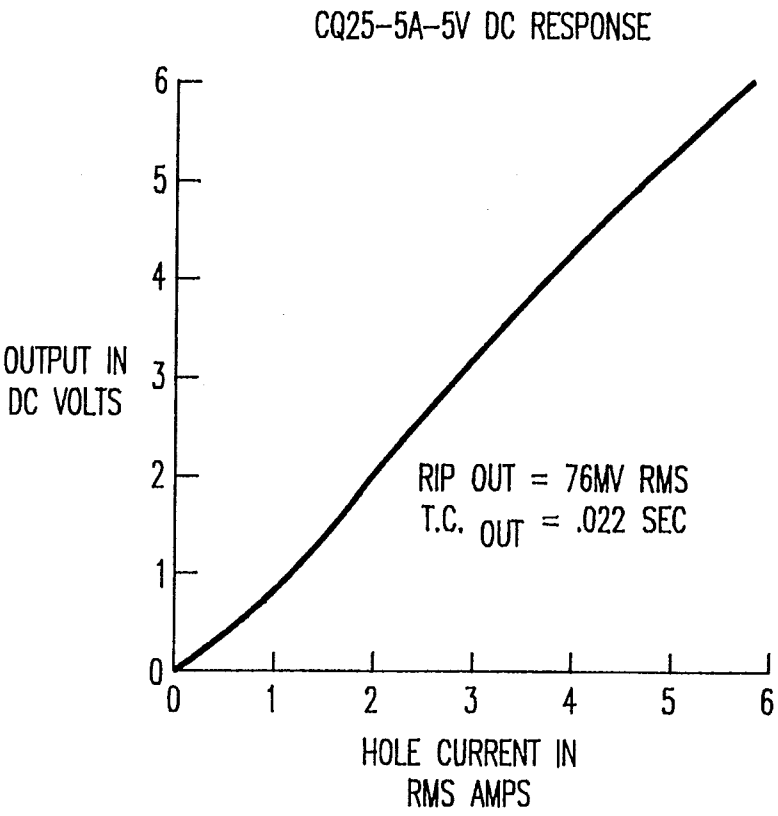
FIG. 20 as a graphical representation of current versus output voltage.

FIG. 17 similar to FIG. 5 but at 30 amperes.

Figure 18:
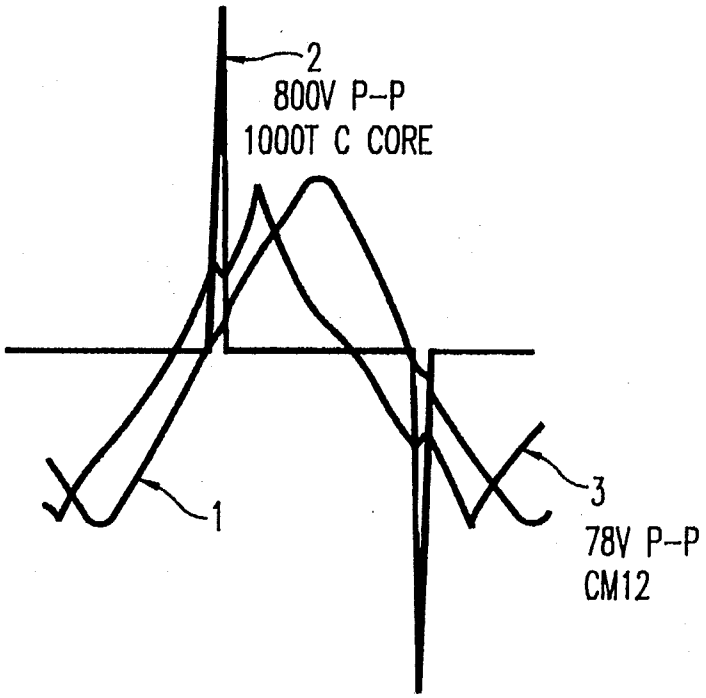
FIG. 18 is a graphical representation of a current wave form comparison re driving current, toroid output and sensor output.

FIG. 18 shows comparisons at 100 amperes with the C core in both cases. Operation with either the CQ-12 or CM-12 is acceptable in this unloaded condition. This fact is extremely important because this is the foundation for the DC output sensors where the output voltage is easily rectified and filtered inside the case. If toroids were used at these light loads the tremendous spikes generated in the voltage output would be difficult to handle.

Figure 19:
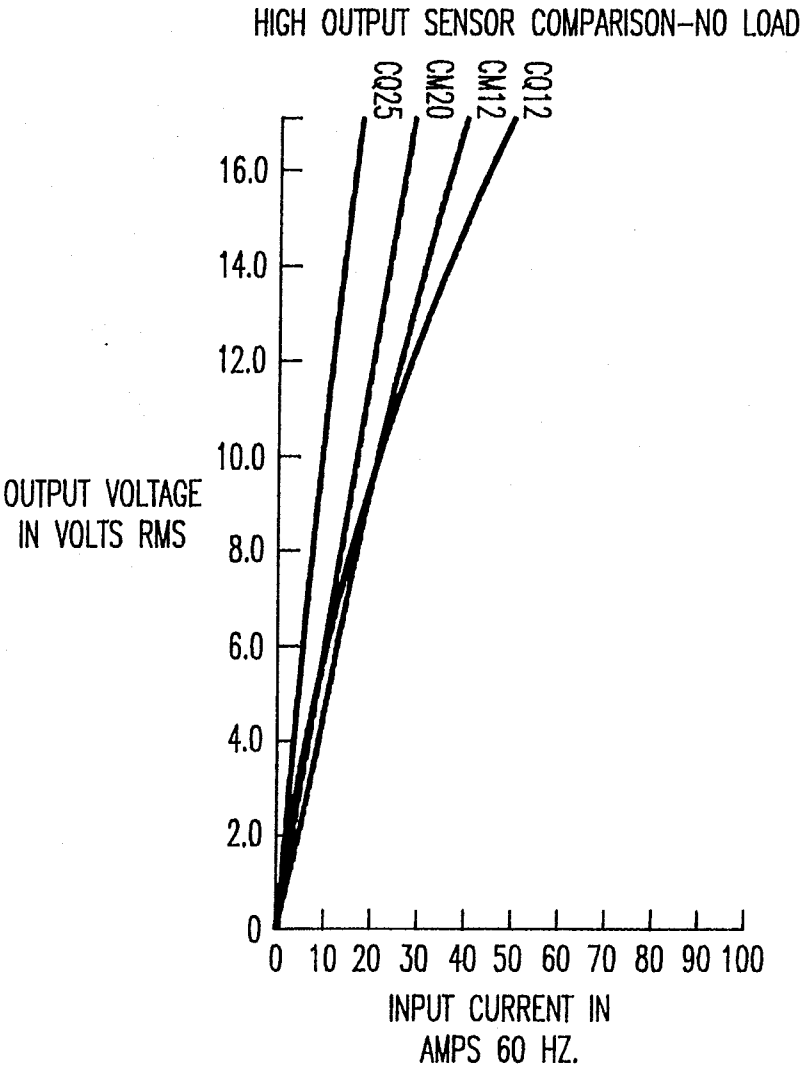
FIG. 19 as a graphical representation of current versus output voltage.
Figure 21:
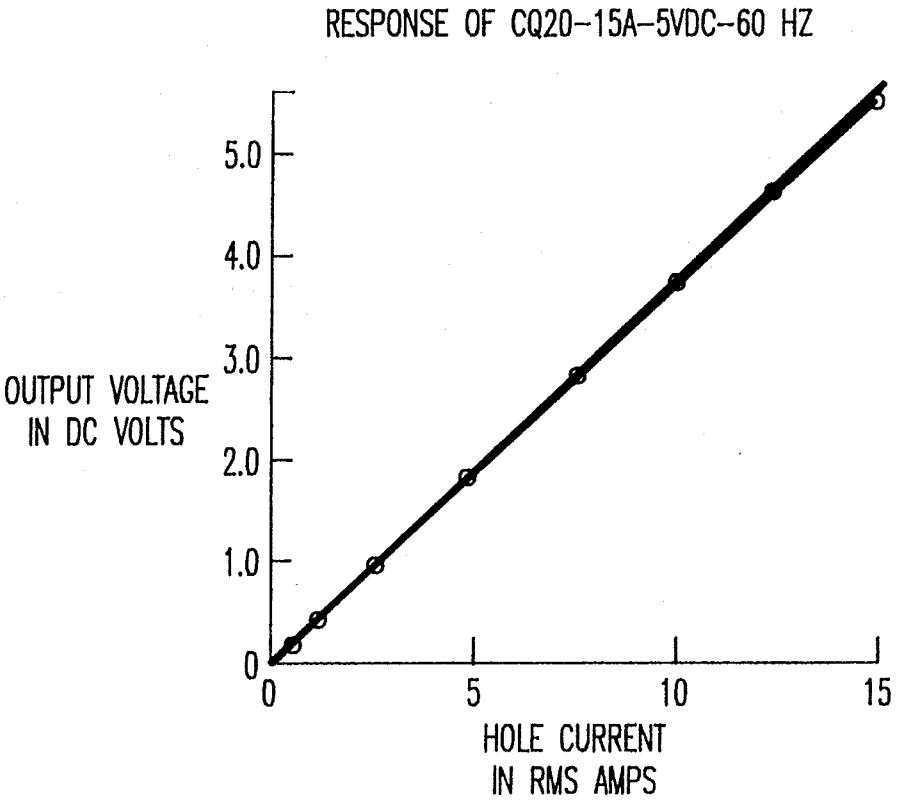
FIG. 21 as a graphical representation of hole current versus output voltage.
Figure 22:
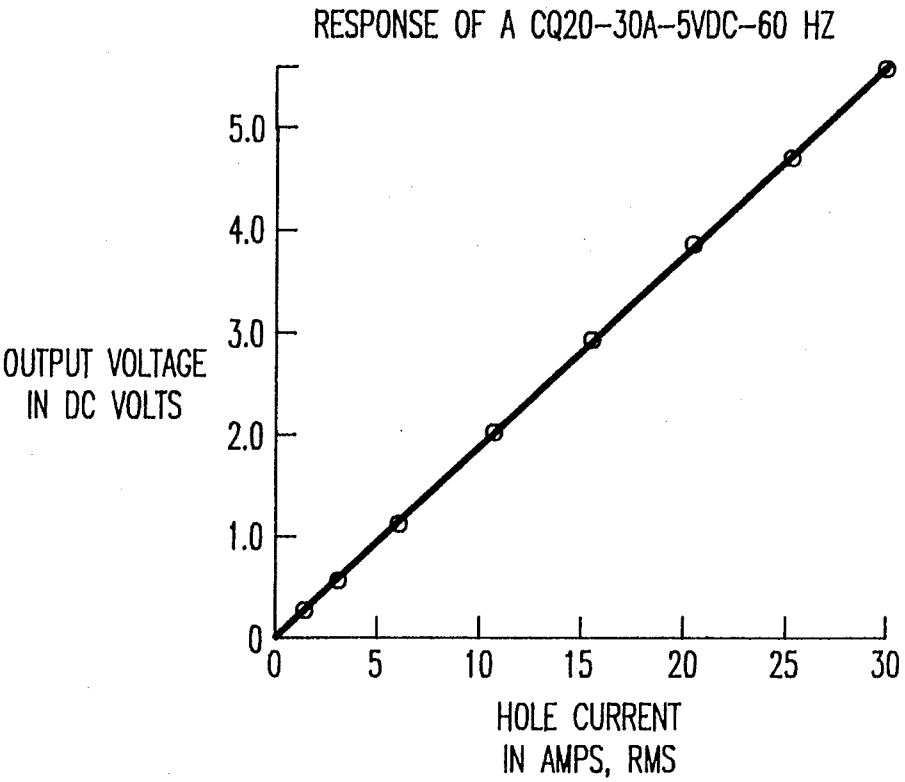
FIG. 22 is a graphical representation of hole current versus output voltage.
Figure 23:
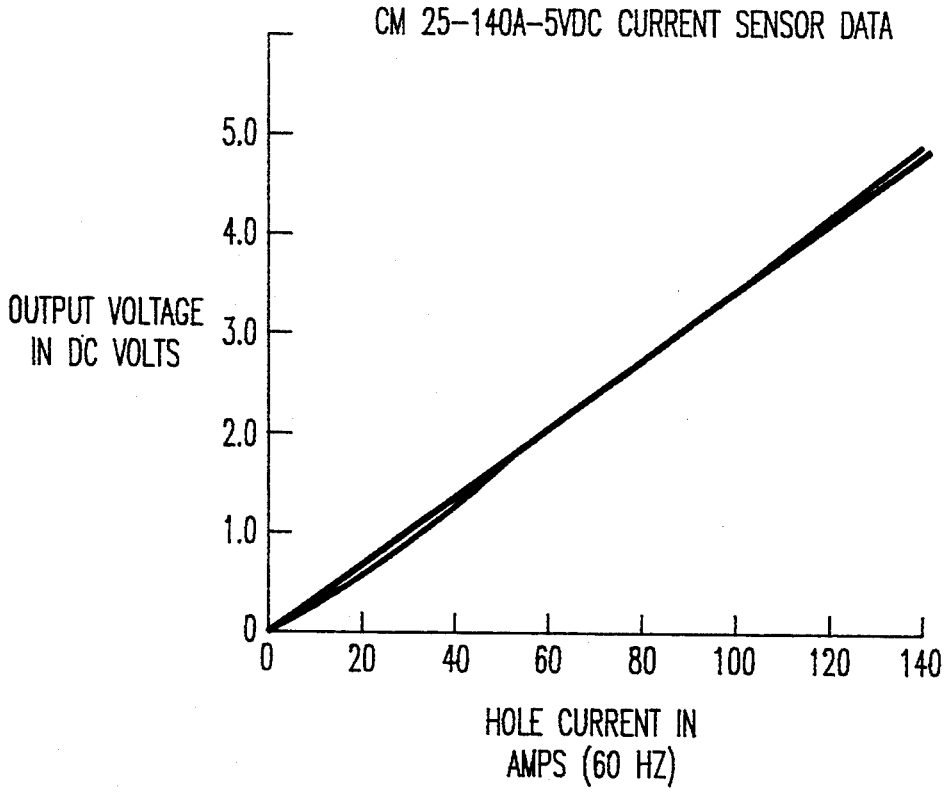
FIG. 23 is a graphical representation of hole current versus output voltage.

FIG. 19 shows the CM-12 and the CM-20 output voltage versus the input current and also the output characteristics for the CQ-12 and CQ-25. Both the CM-20 and CQ-25 are very linear in this lightly loaded (worst case) condition. This suggests that these units will give substantial output after loading for high linearity, which is indeed the case. The CQ-25 is used for the 5 to 60 amperes full scale 5 Volt DC output sensors and, except for the 5 ampere unit which is weak at turn on, all of the others are within 3% of a theoretical straight line linearity including deviation from unit to unit plus full scale offset deviation. The CM-20 Series repeats this specification over the higher current range of 50 to 150 amperes. Therefore, here again, the high linearity unloaded number 6 of "desirable characteristics" has also been met.

FIGS. 20–23 are graphs that show again that it is evident that number 6 of "desirable characteristics" has been met in the 5–140 amperes range with 5 volts DC output at full scale.

Figure 24:
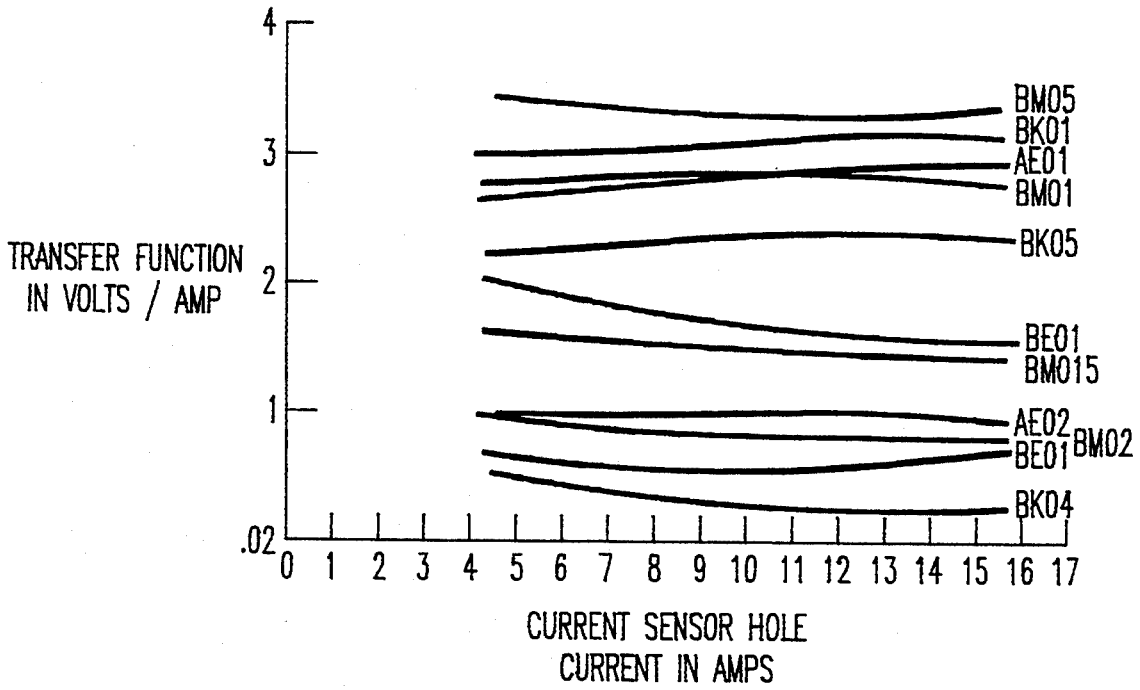
FIG. 24 as a graphical representation of sensor current hole current.

FIG. 24 shows the transfer functions ranging from 0.02 to 0.4 volts per ampere from 0.5 to 1.5 amperes at 132 kilohertz. Operation at 10 Kilohertz has been tested for current sensors CM-01 through CM-16 and CQ-02 and CQ-04 at currents of 1 to 14.5 amperes with transfer functions from 0.042 V/amp up to 0.309 V/amp. All of the outputs are perfect sinewaves. In fact, even 400 Hertz operation is usually a perfect sine wave. Only at 50 Hertz is the hysteresis wave shape predominant.

Further high frequency testing has been done to 68 Megahertz. One interesting test was accomplished using a sweep generator from 100 Kilohertz to 45 Megahertz where an oscilloscope shows the input versus output wave form. Output wave form distortion first occurs at about 6.5 Megahertz and again at about 13 Megahertz and multiplies at higher frequency. Natural resonance is about 20 Megahertz where a tremendous peak of 0.7 volts per line driving volt is registered using a 50 ohm generator and a 100 ohm carbon resistor through the current sensor. It is believed that the distorted operation is caused because the frequency is high enough for eddy-current shielding to occur in the core material causing the electromagnetic field to suffer appreciable attenuation and phase shift.

Figure 25:
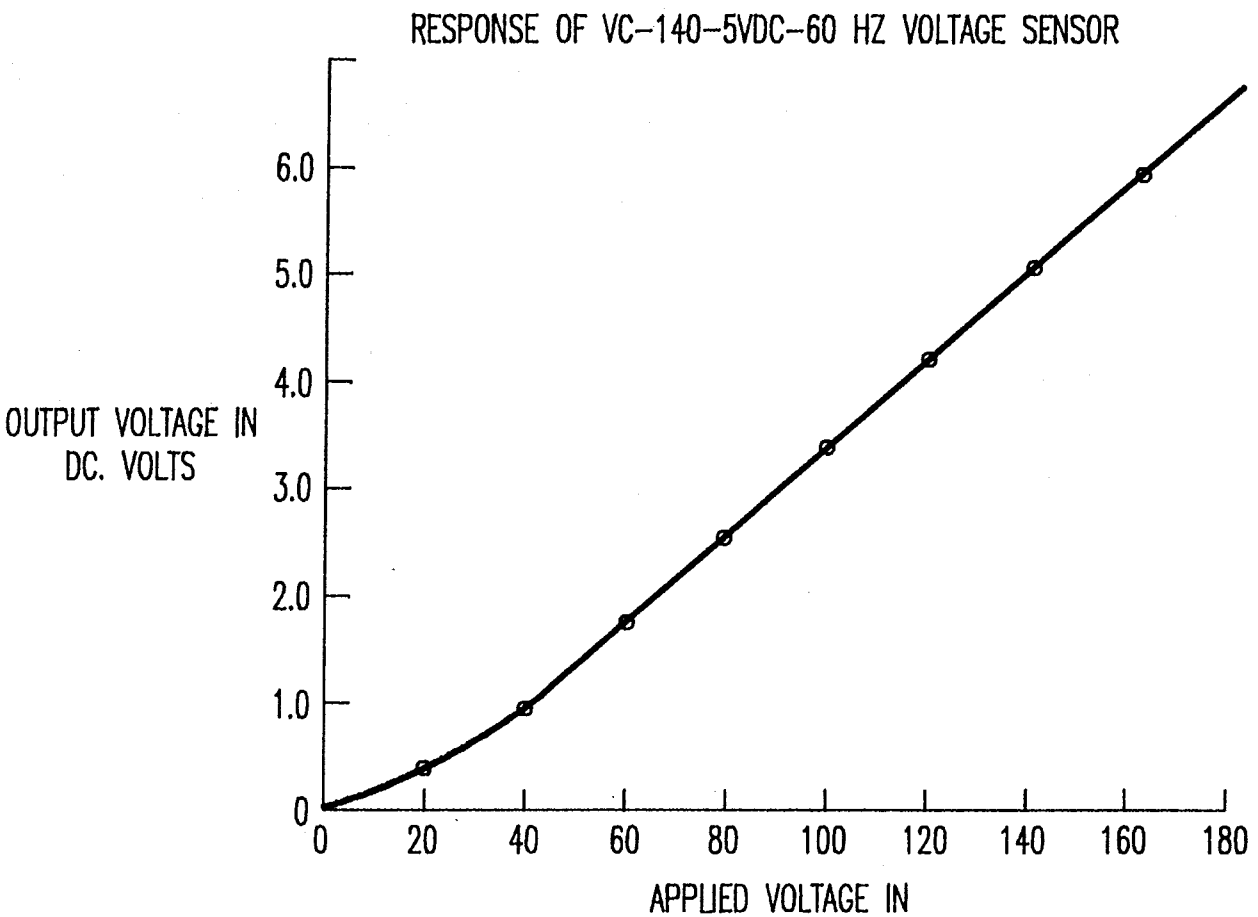
FIG. 25 is a graphical representation of applied voltage versus output voltage.

FIG. 25 shows the response of a voltage sensor with nominal input voltage of 140 volts at 5 volts DC output, 60 Hertz. The voltage sensor is a special adaptation of the current sensor technology. As with the current sensor, it has a floating or isolated output. This graph shows a line very close to a theoretical straight line in a range of 30% of the rated working value.

VOLTAGE OUTPUT REPEATABILITY at IDENTICAL CURRENTS

As drive current is changed, repeatability is gauged by sensor output voltage being identical at the same drive current. This repeatability cannot be expected to hold with an increasing or a decreasing current because of the hysteresis effect of the core material. The repeatability does hold to output resolutions better than a millivolt in either direction. This repeatability effect most probably is due to the low flux density used because of the extremely low coil current drawn due to the high coil impedance. The theory may be explained by the equivalent circuit at low flux densities consisting of a resistance in series with an inductance. When the flux density is low enough for the Rayleigh equations to hold, the variation in the inductance component becomes negligible. The resistance representing the DC resistance and eddy currents at this flux level would also be extremely low leaving only the residual loss which at this level is also minuscule.

TEMPERATURE RANGE

An electromagnetic core assembly consisting of a magnetic alloy core material, some type of enamel wire holder, plus the required number of wire turns should have a wide inherent temperature range of operation. To arrive at this particular criteria the packaging of the unit must be considered. Since most toroids come unpackaged there was no attempt to make a comparison with this new technology. This criteria has been met in the packaging method used for the current sensor developed. A test for a particular core material assembly showed a temperature coefficient of 0.1301% per degree Centigrade between 25 and 100 degrees Centigrade and 0.0711% per degree Centigrade between 25 and −50 degrees Centigrade. At 1 ampere input current, this change in output compared to full scale is 15.09%. At 10 amperes input current for the same assembly, the output compared to full scale was 120.01% for the wide temperature range package. The room temperature epoxy potting package, however, falls off rapidly at low temperature, because the temperature coefficients of the epoxy and the core material oppose each other. Therefore, this package should not be used below about 15 degrees Centigrade. Full scale output drop for some units are over 30% at 0 degrees Centigrade. In spite of this fact, 98 percent of sensors sold are for room temperature usage and since they are potted in epoxy they are the least expensive unit. Since the extended range packaging is available, per the above results, number 9 of "desirable characteristics" has also been met.

Packaging extends to achieving sensors that vary in weight from 3.2 grams to 32 grams including electronics and linearizing circuitry, except for the voltage sensor which is 35 grams. For installation, they are so light usually all that is needed is a tie wrap to fasten the unit to the wire being measured; or there is the option of the printed circuit board mount with the wire being measured run through the sensor hole. The nylon case provides an isolation standoff voltage of up to 16 kilovolts (using a conservative standoff rating of 400 volts per mil). Therefore they work fine on a high voltage line. This sensor should not be confused with a current transformer (CT) or other power conversion device. Unlike a regular CT, which has current flowing in the low impedance secondary (dangerous to the human body if the secondary is "opened"), the user will not get a shock off the terminals. This safe condition is due to the high source impedance inherent in the design. Per #10, the problem of a convenient easy to use package is resolved.

APPLICATIONS

New specific applications for this new technology in current sensing are discovered everyday. By definition, an inductive transducer, or sensor, is needed to process alternating current or voltage. The sensors provide input intelligence for instrumentation or process/control applications. Without the need for auxiliary power to measure current, this line of sensors provide convenience and maximum flexibility to the design engineer. The standard line of sensors, with AC output, is designed for those who prefer to condition their own signals after sensing. The light linearity series, with DC output, are designed specifically for microprocessor or computer interfacing between the electrical process and the controller. All inputs are scaled for the user with 5 volts DC being the normal output at current or voltage desired. To change a process at a particular current, the sensor DC output is used against a reference with a comparator for a decision point, to close or open a contact. In using this series with either current or voltage sensors, the control apparatus could follow the process easily so as to add or drop auxiliary functions at different stages in a process. Use the adjustable Current Actuated Switch current sensor in series on the same line for actuating any number of operations and only the switched lines need to be run to the control point. In fact, it is possible to set up a system with only the auxiliary 117 volt power being used at one main control box in a system and control lines from the current actuated switches running to this control box. The magnetic field sensors are ideal for picking up computer management rotation information without disturbing any part of a working system. Specific applications are AC Inductive Instrumentation Current Sensors:

APPLICATIONS

1. Use the absence of current to signal danger in a process, for example, that a motor has burned out.
2. Use a current sensor output signal to verify that a particular process stage is complete because the slurry is homogeneous and the current has decreased accordingly.
3. Put a current actuated switch on a sump pump, a fan, or a drive mechanism so that operation for too long a period (which causes undue heating from continual current increase) will give the motor a break or shut it down if abnormally high current is reached.
4. Best of all, collect multiple channels of information on any current or voltage at almost any frequency without wasting any power and without loading down the circuitry that is being monitored.
5. Measure power without wasting huge amounts of power just to make the measurement.

General categories of uses for current sensing functions with this technology:

1. Motor protection with motor current sensing.
2. Data acquisition (Computer input circuitry for systems control).
3. Power measurement and control.
4. RF meter substitute (high frequency measurement)
5. Temperature control (via heater current monitoring).
6. Low level current sensing, servomechanism control systems.
7. Current measurement on high voltage leads.
8. Machine control or load control, through current sensing.

As engineers go through this list of general categories they will discover thousands of different and unusual applications for this new technology in current sensing.

The inventor, with many years of instrumentation experience, reviewed the toroid literature because telephone-coil technology and muted core toroids have switching characteristics, with the intent to design an alternating current (AC) sensing device that would be more efficient, and adapted to automatic manufacturing methods better than do conventional toroids or current transfers (CTs). The new device differs from a conventional toroid or CT in that, although it does use an interactive technique, it uses an air-gapped high permeability core in such a manner that it increases its linear response range and minimizes nonlinear saturation effects, resulting in a superior alternating current servicing device (although not intended to be used as a power transfer device). The new device is referred to as an S.R.T. AC current sensor. A particular adaptation of the current sensor technology was used to make an effective DC voltage sensor.

The core material is a homogenous allow everywhere except at the junction where the rapid discharge of energy through the material causes a thin melting layer at the junction where the two ends are joined.

Referring to FIGS. 1–7 of the drawings, a current sensor 10 comprises a straight core 12 of monolithic or single-piece construction magnetic material onto which a wire coil 14 is wound of small diameter transformer wire having an insulted coating thereon. The straight portion **12*a* of core 12 is provided with stops or dams 16, at either end of that portion of the core where the coil is to be wound, to limit the width of the coil. The stops 16 may be made up of one or more pieces 18*a* and 18*b* of shrink tubing shrunk onto the core. The core 12 is placed in a suitable rotating winding chuck with the core serving as a straight wire mandrel. The wire coil 14 or winding means is wound onto the straight mandrel and secured at the ends by pigtails 20 tied around the stops 16. The ends 22 and 24 of the straight wire core 12 is then bent into a D-shaped core while the portion of the core supporting the coil is maintained straight. The ends 22 and 24 of the core 12 are magnetically connected together by suitable means, such as a press resistance weld as at 30**.

Figure 3:
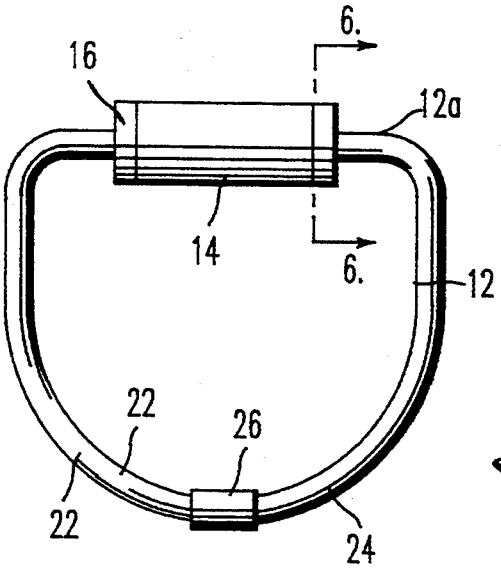
FIG. 3 is a plan view of the current sensor illustrating one method of connecting the ends of the D-shaped core.

In FIG. 3, a preferred method of magnetically connecting the bent ends 22 and 24 is shown as by placing a magnetic sleeve 26 over the ends 22 and 24 abutting one another and then crimping the sleeve to physically secure and hold the ends together in a magnetic connection.

Figure 4:
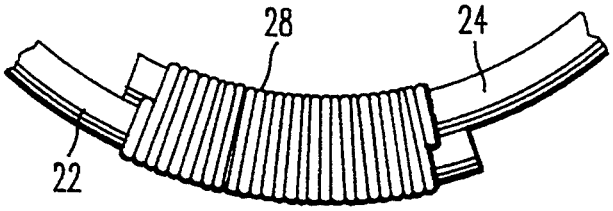
FIG. 4 is a plan view of still another method of connecting the ends of the D-shaped core with portions broken away to conserve space.

FIG. 4 illustrates still another suitable method of connecting the bent ends 22 and 24 together. Here, the ends 22 and 24 are overlapped and magnetic wire 28 is wound tightly over the lapped core ends. The wire may be tied, cemented, or soldered at low heat to hold the wire in place.

FIG. 5 illustrates still another method of magnetically connecting the bent ends of the core 12. Here, the bent ends 22 and 24 of the core are overlapped and secured together by resistance compression welding as at 30.

Figure 6:
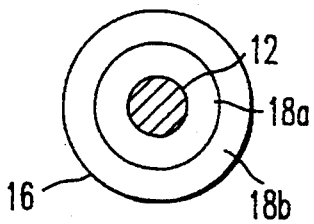
FIG. 6 is a view along line 6—6 of FIG. 1.

As seen in FIG. 6, the stops 16 are preferably formed of short pieces of shrink tubing 18*a* and 18*b* slid over the straight wire core and shrunk first to the core and then to each other.

Figure 7:
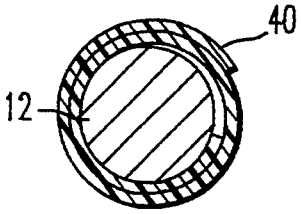
FIG. 7 illustrates another form of a coil end or spool using plastic strips cemented to the core.

Strips of plastic 40 cemented to the core 12 may also be used as illustrated in FIG. 7.

Figure 1:
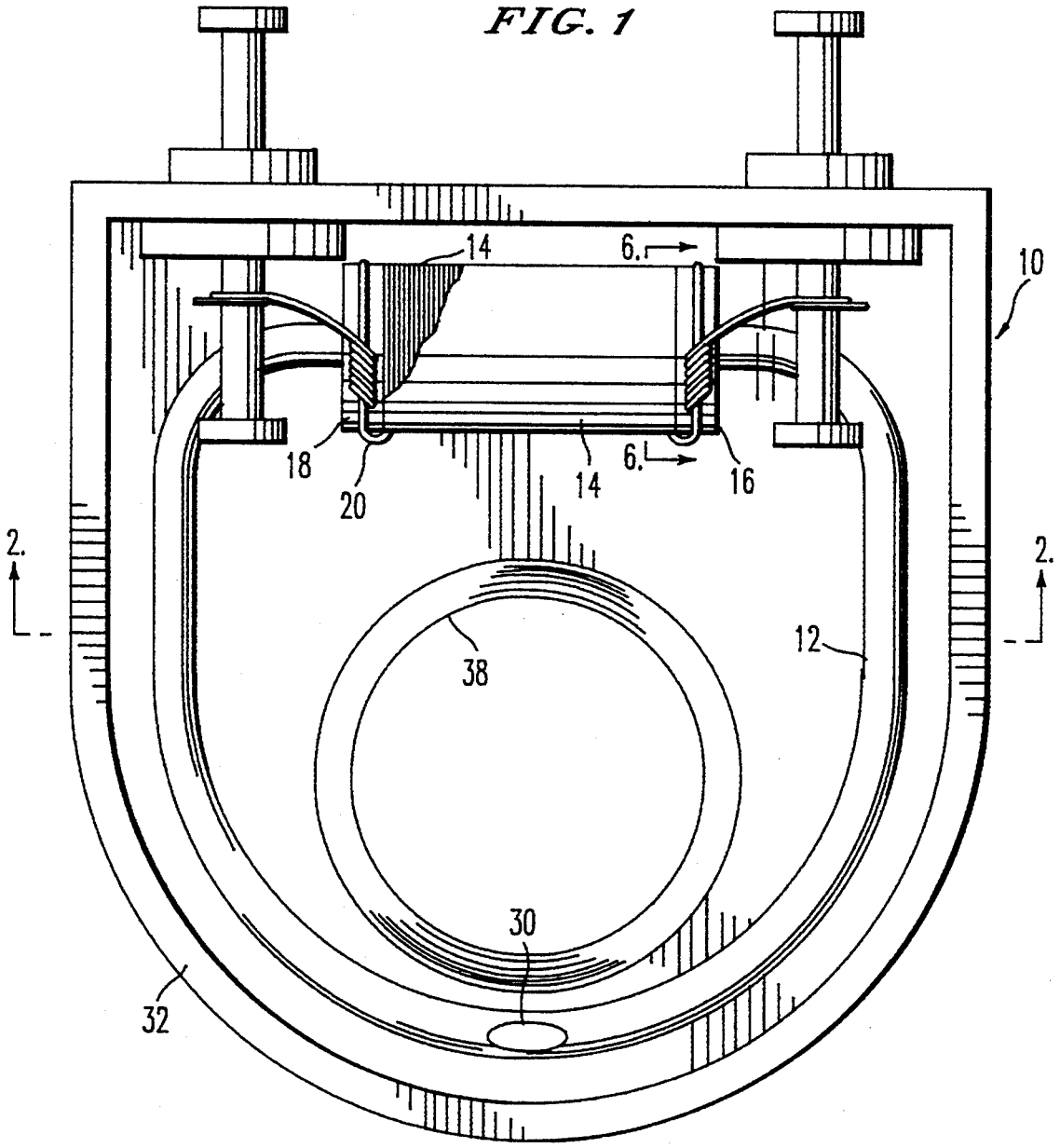
FIG. 1 is a plan view of a preferred form of the current sensor according to the invention mounted in a plastic case.
Figure 2:
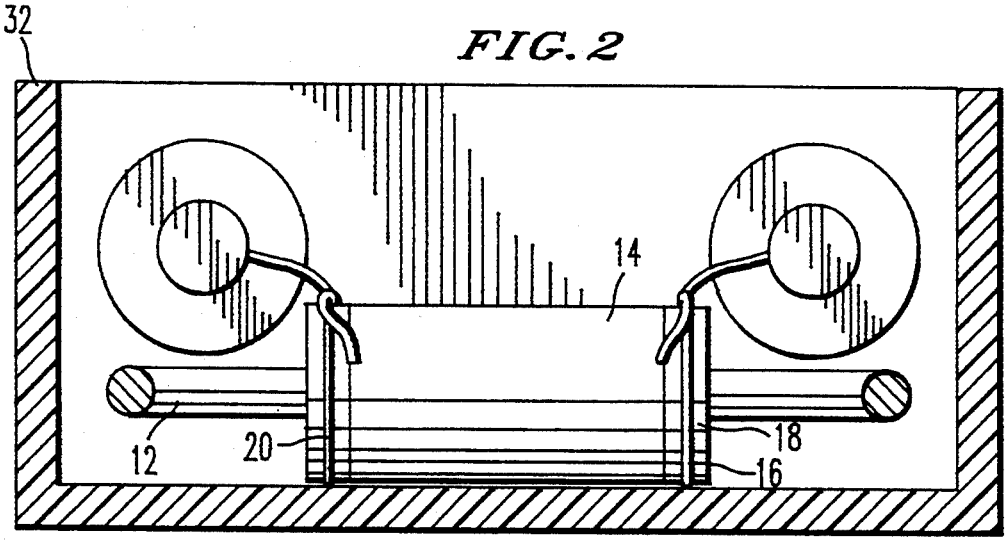
FIG. 2 is a view along line 2—2 of FIG. 1.

As shown in FIG. 1, the current sensor 10 is mounted in a plastic case 32 which is filled with a suitable potting compound. It may be desirable to dip the entire coil and core assembly into a polyurethane cushion so that shrinking action of the potting compound will not break coil wires or pigtails. The case 32 is shaped to receive the D-shaped structure of the sensor and is provided with two solder lugs 34 and 36 to which the pigtails 20 are soldered with low temperature solder and the case is further provided with an opening 38 through which a current carrying conductor is threaded (not shown) to position same as near the single-turn primary 12 of the sensor 10 as possible for maximum current sensitivity.

Figure 8:
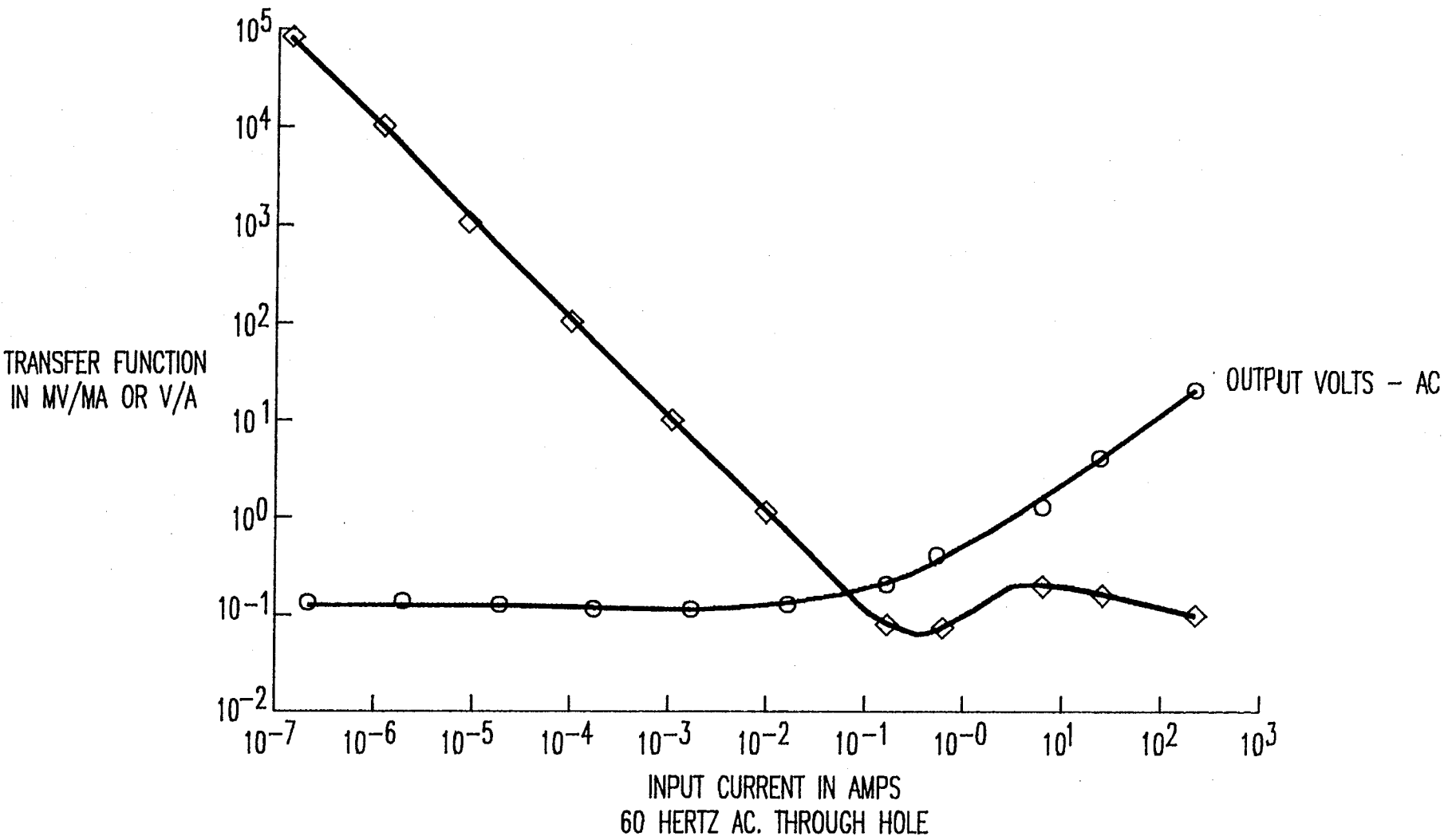
FIG. 8 is a graphical representation of the transfer function of a sensor type BG in volts output versus current at 60 hertz.

One type of sensor, type BG, the characteristics of which are illustrated in FIG. 8 for a frequency of 60 Hz, has a high mu core so that at very low current levels the transfer function is high compared with the transfer function characteristics of sensor type BE.

Figure 9:
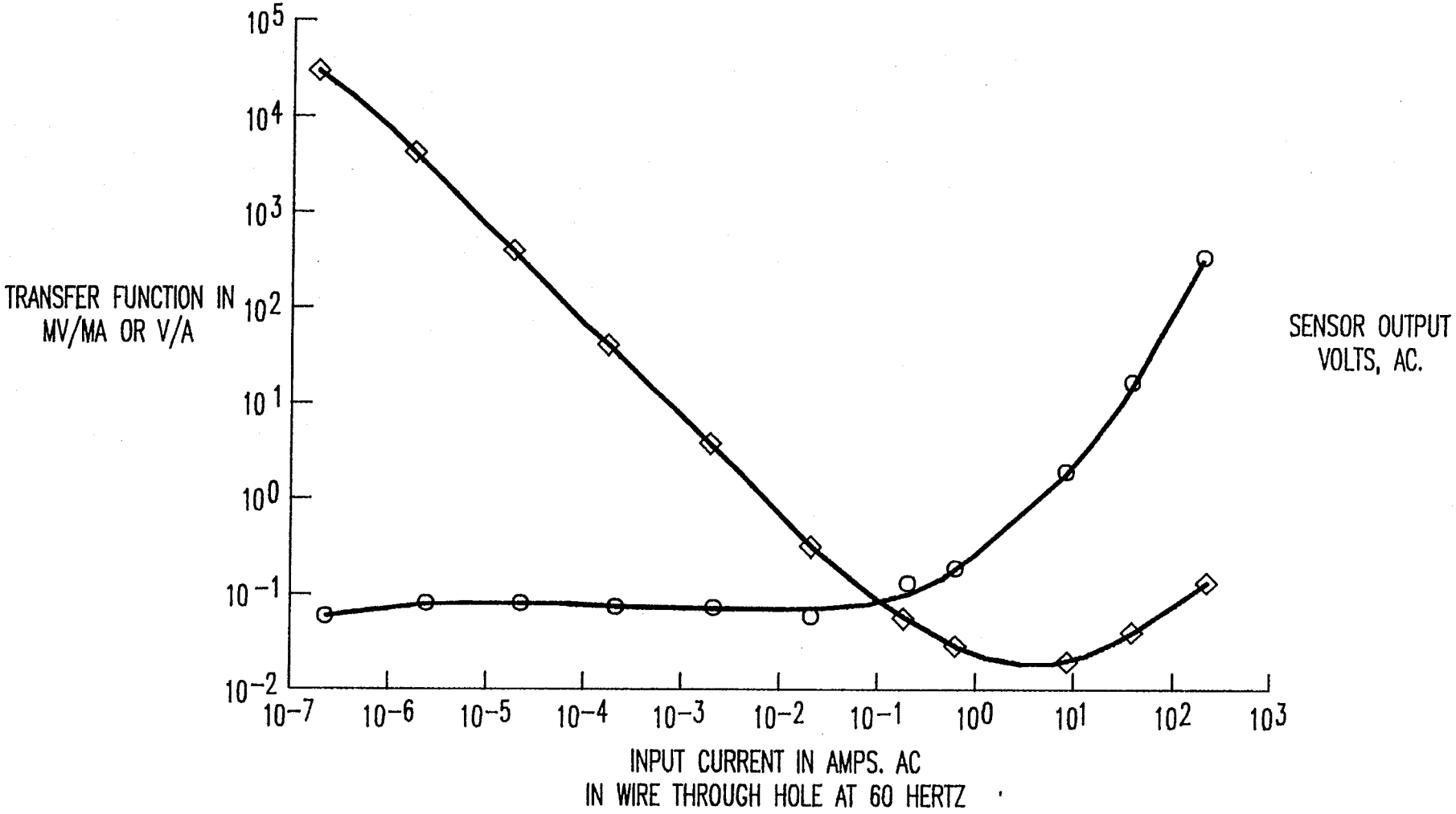
FIG. 9 is a graphical representation of the transfer function of a sensor type BE in volts output versus input current at 60 hertz.

The transfer function characteristics of the BE sensor type are illustrated in FIG. 9 at a frequency of 60 hertz.

The type BE of FIG. 9, however, can be used to 240 amps (maximum amperage tested) up to probably 1000 amps before saturation begins, since the core 12 of the type BE sensor is much lower ("mu") $\mu$ or permeability than type BG sensor. Type BG sensor starts to saturate before 10 amps and is usable at 100 and 240 amps but the output decreases sharply at the higher value where the type BE sensor output is still increasing with increasing current passing through the conductor opening 38.

Figure 10:
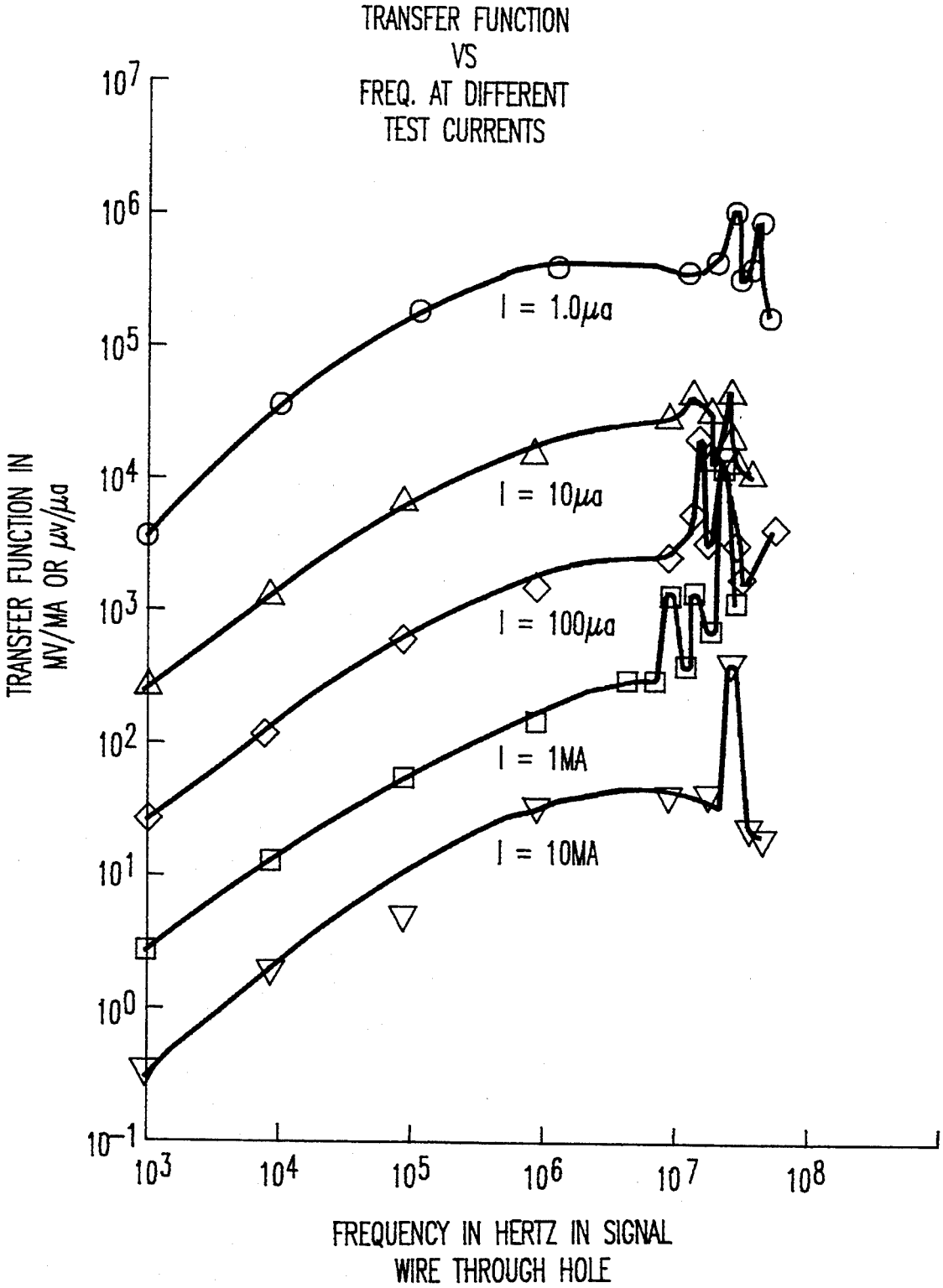
FIG. 10 is a graphical representation of the transfer function of a sensor type AO versus frequency at different test currents; and, FIG. 11 is a graphical representation of the transfer function of a sensor type BE versus frequency at different test currents.
Figure 11:
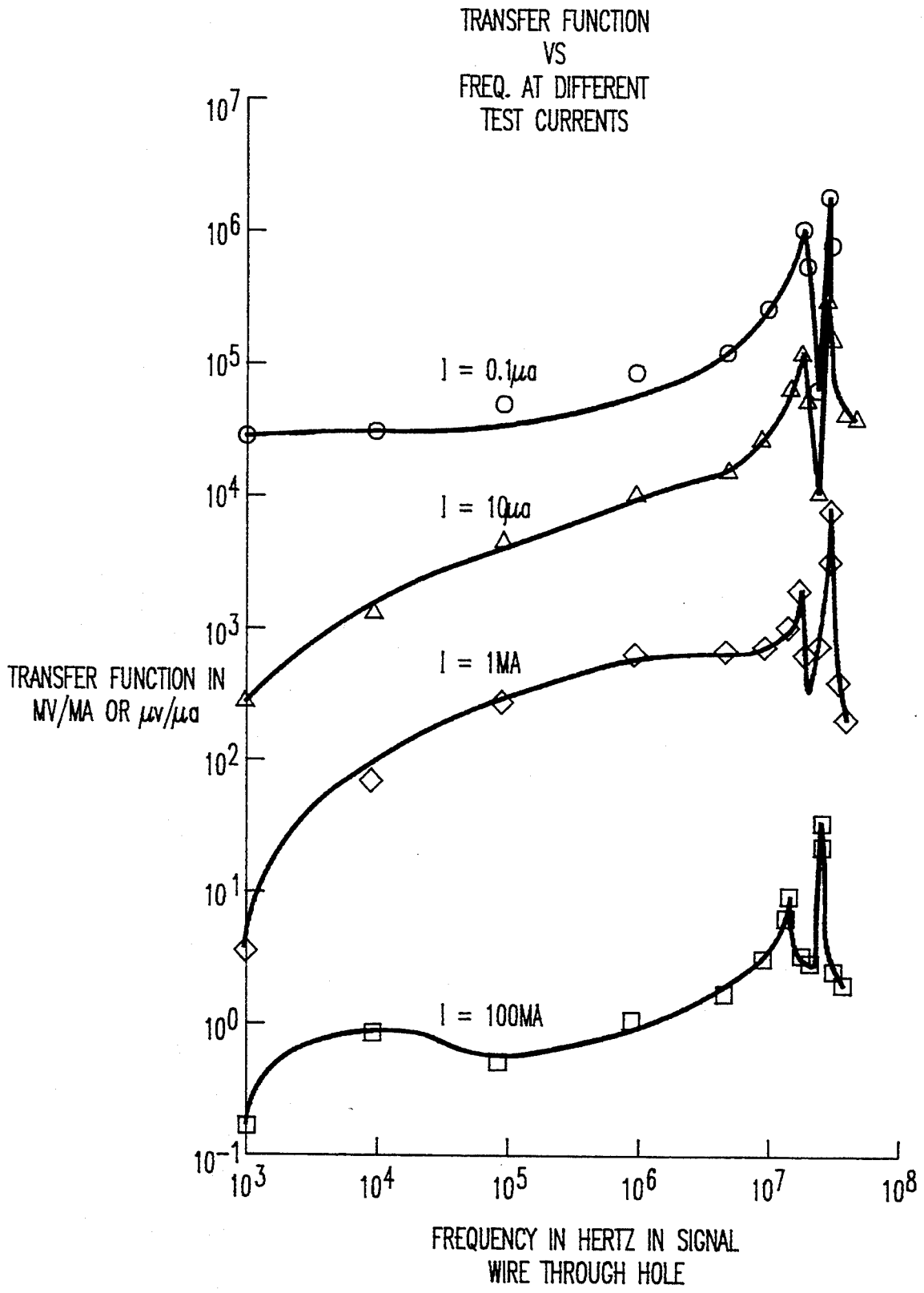

The transfer function versus frequency do not lend themselves to direct comparison since their cores 12 are of different diameter. If type AO sensor of FIG. 10 is tested to 0.1 microamp, its transfer function would be higher than sensor type BE of FIG. 9. The curves of FIGS. 8, 9 and 10 are run on sensors having the same number of turns in coil 14. The sensor type AO of FIG. 10 is designed for use on low level instrumentation applications whereas sensor type BE is a high current AC 60 Hertz sensor, which nonetheless works very well across a wide frequency band at somewhat lower output, as shown by FIG. 11.

While there have been described what at present are considered to be the preferred embodiments of this invention, it will be obvious to those skilled in the art that various changes and modifications may be made therein without departing from the invention. It is aimed, therefore, in the appended claims to cover all such changes and modifications which fall within the true spirit and scope of the invention.

We claim:

1. A current sensor for sensing current in a current carrying wire, comprising:

a magnetic core made of a single integral piece having a generally circular cross-section and made of a magnetic material, said core having a straight central section between a first end section and a second end section, said first end section extending from said central section to a first core end of said core, said second end section extending from said central section to a second core end of said core;

an insulated conducting transformer wire having a first wire end and a second wire end, said wire wound directly onto said central section forming a plurality of turns around said central section;

wherein at least one of said first end section and said second end section is deformed so that said first core end is welded to said second core end and said first end section is magnetically coupled with said second end section forming a single magnetic flux loop;

wherein surfaces of said current sensor define a hole passing through said magnetic flux loop; and wherein the number of turns of said plurality of turns is at least 1000.

2. A sensor according to claim 1, wherein:

the number of turns of said plurality of turns is at least 2000.

3. A sensor according to claim 1, wherein:

the number of turns of said plurality of turns is at least 4000.

4. A sensor according to claim 1, wherein:

the number of turns of said plurality of turns is at least 12000.

5. A sensor according to claim 1, wherein:

when a current I passes through said hole a voltage V is generated in said winding satisfying the inequality $V/I>0.1$ for at least one value of I.

6. A sensor according to claim 1, wherein:

when a current I passes through said hole a voltage V is generated in said winding satisfying the inequality $V/I>0.4$ for at least one value of I.

7. A sensor according to claim 1, wherein:

when a current I passes through said hole a voltage V is generated in said winding and the ratio of V to I is linear within 3 percent over a current range from I to 5I for at least one value for I.

8. A sensor according to claim 1, wherein:

said sensor draws less than 5 watts of power when a voltage of between zero and five volts is generated between said first wire end and said second wire end.

9. A sensor according to claim 1, wherein:

said sensor draws less than 1 watt of power when a voltage of between zero and five volts is generated between said first wire end and said second wire end.

10. A sensor according to claim 1, wherein:

said sensor draws less than 0.1 watt of power when a voltage of between zero and five volts is generated between said first wire end and said second wire end.

11. A sensor according to claim 1, wherein:

said first wire end is connected to said second wire end across a resistance of at least 2000 ohms.

12. A sensor according to claim 1, wherein:

said first wire end is connected to said second wire end across a resistance of at least 7000 ohms.

13. A sensor according to claim 1, wherein:

when an alternating current having a first period passes through said hole a voltage induced in said wire does not have voltage spikes of substantially shorter duration than said first period.

14. A sensor according to claim 1, wherein:

when an alternating current passes through said hole a voltage V is induced in said wire and a derivative of said voltage with respect to time t, dV/dt, is continuous.

15. A sensor according to claim 1, wherein:

part of said first end section overlaps and is adjacent to part of said second end section and the first and second end sections are connected to one another by said weld, said weld being located along the overlap region between said first end section and said second end section.

16. A sensor according to claim 1, further comprising:

a first spool end and a second spool end, said first spool end opposing said second spool end, said plurality of windings disposed between said first spool end and said second spool end, said first spool end and said second spool end mounted to said central section.

17. A sensor according to claim 1, wherein:

said magnetic core is formed into a "D" shape.

18. A sensor according to claim 1, wherein:

said central section, said first end section, and said second end section all lie within the same plane.

19. A sensor for sensing current in a wire, said sensor comprising a magnetic core having a generally circular cross-section and made of a magnetic material, said core having a straight central section between a first end section and a second end section, said first end section extending from said central section to a first core end of said core, said second end section extending from said central section to a second core end of said core; an insulated conducting transformer wire having a first wire end and a second wire end, said wire wound around said central section to form a plurality of turns around said central section; wherein at least one of said first end section and said second end section is deformed so that said first core end is welded to said second core end and said first end section is magnetically coupled with said second end section forming a single magnetic flux loop; wherein the number of turns of said plurality of turns is at least 1000; and wherein surfaces of said current sensor define a hole passing through said magnetic flux loop, formed by the process of:

winding at least 1000 turns of said insulated conducting transformer wire directly onto said magnetic core; and then bending at least one of the first end section and the second end section toward the other one of the first end section and the second end section.

* * * * *